United States Patent [19]

Hinchcliffe et al.

[11] Patent Number: 4,505,091

[45] Date of Patent: Mar. 19, 1985

[54] PACKING MACHINE CONTROL

[75] Inventors: Dennis Hinchcliffe; Anthony P. Wright, both of London, England

[73] Assignee: Molins PLC, London, England

[21] Appl. No.: 376,447

[22] Filed: May 10, 1982

[30] Foreign Application Priority Data

May 20, 1981 [GB] United Kingdom ..... 8115455
Jul. 13, 1981 [GB] United Kingdom ..... 8121570

[51] Int. Cl.[3] ..... B65B 57/16

[52] U.S. Cl. ..... 53/444; 53/500; 221/1; 221/17; 221/21

[58] Field of Search ..... 53/57, 58, 236, 444, 53/148, 494, 495, 498, 500; 221/1, 17, 21

[56] References Cited

U.S. PATENT DOCUMENTS

| | | | |
|---|---|---|---|
| 1,964,925 | 7/1934 | Meyer-Jagenberg | 53/57 |
| 3,175,336 | 3/1965 | O'Neel et al. | 53/58 |
| 3,269,085 | 8/1966 | Czajkowski | 53/57 X |
| 3,279,148 | 10/1966 | Henn | 53/57 X |
| 3,838,663 | 10/1974 | Focke . | |
| 4,044,779 | 8/1977 | Preston et al. . | |

FOREIGN PATENT DOCUMENTS

| | | |
|---|---|---|
| 867311 | 5/1961 | United Kingdom . |
| 1289458 | 9/1972 | United Kingdom . |
| 1298785 | 12/1972 | United Kingdom . |
| 1429642 | 3/1973 | United Kingdom . |
| 1349251 | 4/1974 | United Kingdom . |
| 2030101 | 4/1980 | United Kingdom . |

*Primary Examiner*—Horace M. Culver
*Attorney, Agent, or Firm*—John C. Smith, Jr.

[57] ABSTRACT

A control device for re-starting a cigarette packing machine, while it is slowing down after having cleared itself of a cigarette starvation condition in a flow channel (2), comprises: a triggering circuit (A2, I1) pulsed by a stroboscopic switch (S1) at machine speed, and controlling two flip-flop counters (F1 and F2); a fault emission circuit (R1, C1, R2, C2 and A1) fed from the starvation detector switch (40); a main shut-down circuit (I2, S2) connected from the output of one flip-flop (F1); and a re-start circuit (C3, R3, S3) connected from the output of the other flip-flop (F2).

7 Claims, 3 Drawing Figures

PACKING MACHINE CONTROL

This invention concerns improvements in controlling the feed of rod-like articles such as cigarettes, in particular on a cigarette packing machine prior to the cigarettes being batched into groups.

In cigarette packing machines, for example on the Molins HLP4 machine, cigarettes are stored in a hopper from where they pass under gravity down a number of vertical channels defined by narrow vanes. At the bottom of the channels groups of cigarettes are ejected, usually 20 in number, and are fed onwards along the machine for enclosure in packets. To ensure that the channels are being fed regularly from the hopper, so that no "starvation" condition occurs, it is known to provide a mechanical detector. If the detector senses such a starvation condition, it causes the packing machine to decelerate to a stop, so that the fault can be rectified by the machine operator. It has been found, however, that in the time required to bring the machine to rest, the starvation condition may frequently clear itself, possibly as a result of the deceleration of the machine. When the machine has stopped, the operator therefore has to check that there is no longer a fault and then re-start the machine. In the meantime valuable production has been unnecessarily lost.

With a view to mitigating this problem, the present invention provides a method of controlling the operation of a machine for feeding rod-like articles, such as a cigarette packing machine, in which the articles are fed intermittently along a channel in juxtaposed relationship, comprising the steps of detecting the articles in the channel when at rest between intermittent feeding, emitting a fault signal upon detection of the absence of articles, initiating the stoppage of the machine upon receipt of a fault signal, and restarting the machine if no further fault signal is received for a predetermined period of time.

The invention also provides a device for controlling the operation of a machine for feeding rod-like articles, such as a cigarette packing machine, comprising means defining at least one flow channel along which the articles are fed intermittently in juxtaposed relationship, detection means for detecting the articles in said channel when at rest between intermittent feeding and for emitting a fault signal upon detection of the absence of articles in said channel, and control means operative to initiate stoppage of the machine upon receipt of a fault signal and to re-start the machine no further fault signal is received for a predetermined period of time.

Preferably said control means comprises a triggering circuit pulsed in timed relationship with the intermittent feeding steps and effective to stop the machine in the event that any two consecutive fault signals are received from the detection means.

The control means may also include a delay circuit to ensure that a good signal following a first fault signal will only be effective if received within a predetermined time delay. In this way if the machine is, for example, stopped manually after a fault signal, if cannot automatically restart itself.

An embodiment of the invention will now be described by way of example with reference to the accompanying drawings in which.

Figure 1:
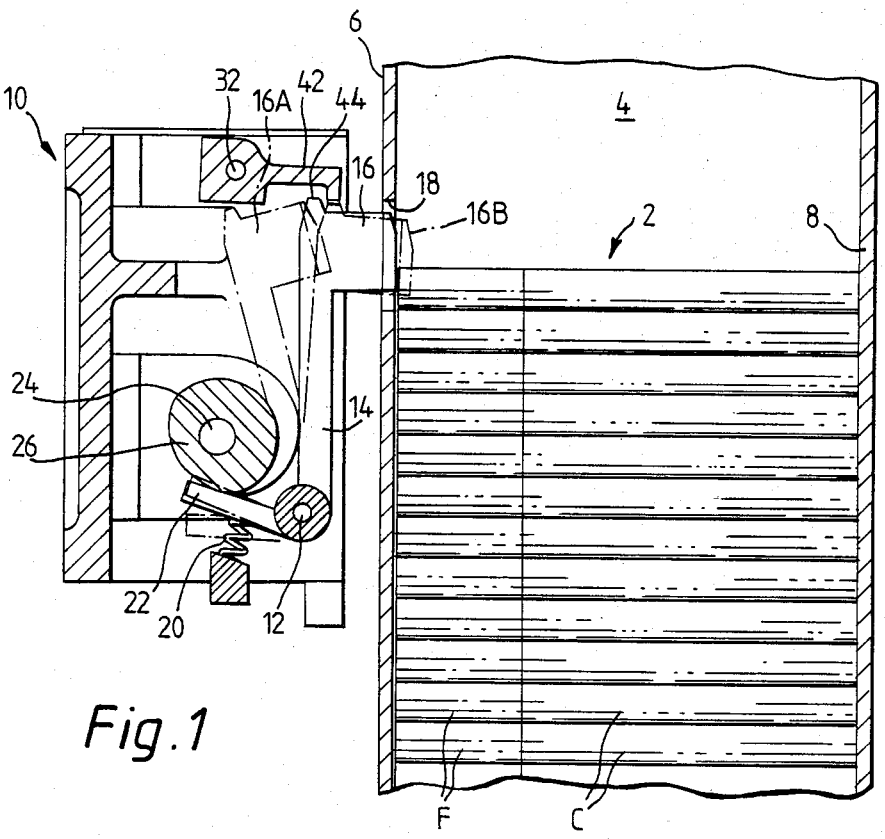
FIG. 1 is a sectional side view of a mechanical detector for a packing machine.

Referring first to FIG. 1, the reference 2 indicates generally one of seven cigarette flow channels extending downwards from a hopper (not shown) of a cigarette packing machine. The width of each channel, defined by side walls 4 (only one shown), in slightly greater than the diameter of a cigarette, so that a single column of cigarettes C can freely pass down the channel. To the left and right, as viewed in FIG. 1, the channels are closed by upright end walls 6 and 8 respectively, the filter ends F of the cigarettes being adjacent to the end wall 6, while their tobacco ends are adjacent the end wall 8. At the bottom of each channel two or three rows of cigarettes are intermittently pushed out in a horizontal direction, (by ejection mechanism not constituting part of this invention), thus forming groups of cigarettes to be packed.

Figure 2:
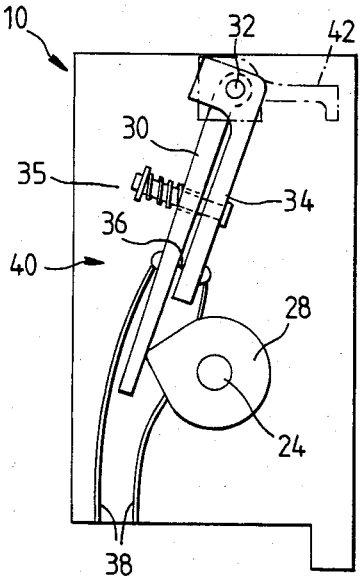
FIG. 2 is a similar view but showing a switch mechanism hidden behind FIG. 1.

Referring now also to FIG. 2, mounted to the left of the end wall 6 is a detector 10 for detecting whether each channel has been filled with cigarettes from the hopper. Extending horizontally through the detector 10 is a spindle 12 about which is pivoted at each channel 2 a feeler arm 14. As the mechanism is the same in each channel, only one will be described. At the free end of arm 14 is a flat feeler head 16 which, upon clockwise pivoting of the arm 14, is movable into the respective channel 2 through a narrow slot 18 formed in the wall 6. The arm 14 is biassed clockwise by a spring 20, which acts against the underside of the free end of a short lever 22 integral with the arm and extending towards the left of the spindle 12.

Mounted on a cam shaft 24 above each lever 22 is a cam 26 operating against the top side of the lever 22. Also mounted at one end of the shaft 24 is a single switch cam 28 (see FIG. 2) which acts against an arm 30 pivoted about a spindle 32 above and parallel to the shaft 24. Clamped fast to the spindle 32 is an arm 34 which is biased towards the arm 30 by a spring 35. Formed at the insides of arms 30 and 34 are aligned contacts 36 which are connected to respective electrical leads 38, thus constituting a normally closed switch 40.

Clamped also to the spindle 32 is a single detector arm 42 (shown chain dotted in FIG. 2) which extends across the top of each feeler arm 14. Formed at the top of each feeler head 16 is a projection 44 which is located such that with the head 16 in the extreme right-hand position, shown chain dotted at 16B, the projection is aligned with the downwardly pointed free end of the detector arm 42.

The mechanical operation of the detector 10 will now be described.

The cam shaft 24 is driven at the same speed as the packing machine, i.e. such that the cams 26 rotate once for each group of cigarettes which are pushed out by the ejection mechanism at the bottom of the channels 2. After each such ejection the cigarette in the channels 2 pass downwards by gravity, descending a distance of two or three cigarettes, according on the number of rows ejected.

Let it be assumed first that cigarettes continue to be supplied to the channels 2 from the cigarette hopper, so that cigarettes are present at the level at which the feeler head 16 operates. In this condition, as each cam 26 moves from its maximum rise position to its minimum position, it allows the spring 20 to urge the respective head 16 from its leftmost position, shown chain dotted at 16A, to the position shown in full line. In this position the head 16 just enters the slot 18 in the wall 6 and then abuts the filter end F of one or more cigarettes C. It will be seen that the projections 44 thus come to rest to the left of the free end of the detector arm 42. At this point of time the switch cam 28 is at the angular position shown in FIG. 2, so that the arm 42 is free to move down in front of the projection 44, i.e. beyond the position shown in FIG. 1. Thus, as no obstruction is encountered by the arm 42, the contacts 36 of the arms 30 and 34 remain together, so that the switch 40 remains closed.

If now, at a subsequent cycle of operations, cigarettes have failed to be fed into any one of the channels 2, resulting in a so-called "starvation" condition, the spring 20 will cause the respective head 16 to move further into that channel, namely to the chain-dotted position 16B. Since the projection 44 is now in line with the end of the detector arm 42, full movement of the latter, and therefore also of the arm 34, is prevented. Thus the final rising movement of the switch cam 28 causes the arm 30 to move away from the arm 34, thus breaking the contacts 36 of the switch 40.

Figure 3:
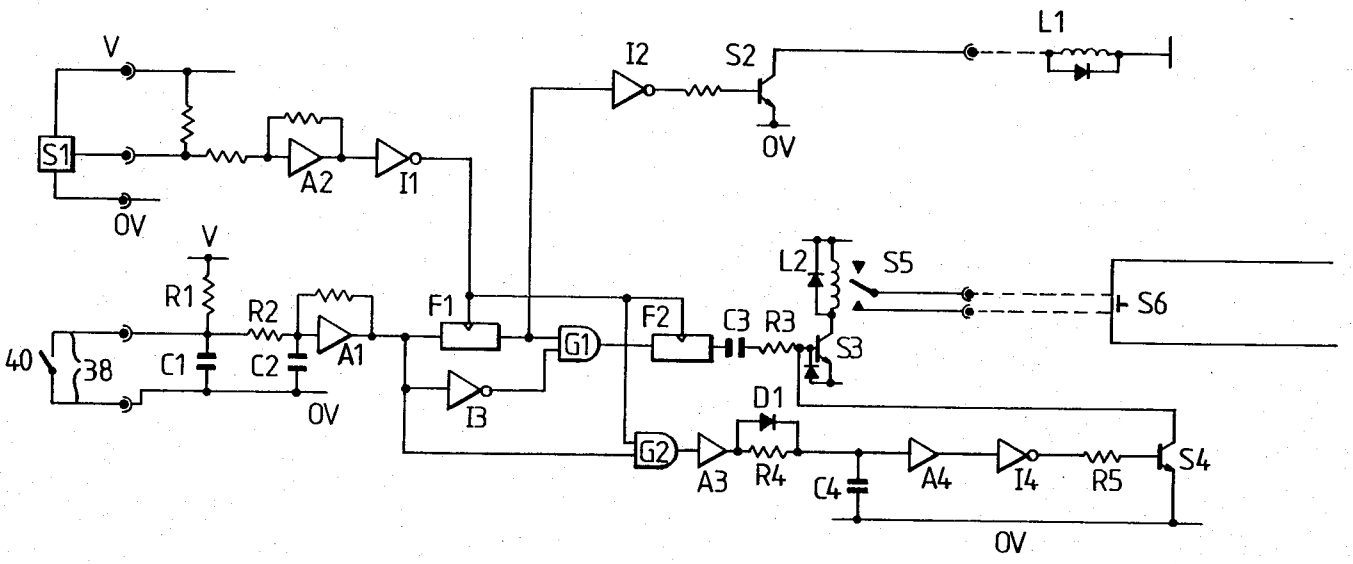
FIG. 3 is a circuit diagram of a device for controlling the machine according to the invention.

Referring now to FIG. 3, the switch 40 is connected to a smoothing filter, consisting of a pair of capacitors C1 and C2 parallel with the switch, and a resistor R2 between the capacitors. A smoothed D.C. potential V, of about 16 Volts, is applied across a resistor R1 to one side of the switch 40, the other side of which is at zero potential 0 V. Opening of switch 40, as above described, produces a "high" fault signal, by way of an increase in potential across the resistor R2. This signal is shaped by a booster amplifier A1 and input to a D-type flip-flop F1 or counter.

Also connected to the flip-flop F1 is a trigger-circuit, including a stroboscopic switch S1 pulsed at the machine cycle speed by a rotating flag member (not shown) and connected through a booster amplifier A2 and pulse invertor I1 to the flip-flop F1. A triggering pulse from S1 thus transmits the high fault signal from the input to the output side of the flip-flop F1, and then through an invertor I2 to switch off transistor switch S2, and thus de-energise a relay L1 to deactivate the main motor driving the packing machine.

As the machine takes at least two cycles to come to rest, if at the second cycle the channel 2 is still starved of cigarettes C, the next opening of the switch 40, will produce a second fault signal whose effect is to maintain the switch S2 off and thus prevent reactivation of the main motor. On the other hand if the channel 2 fills with the cigarettes, immediately following the first fault signal, the switch 40 will remain closed and a "low" signal will be input to the flip-flop F1 which causes the switch S2 to be closed again, permitting the motor to be reactivated by the circuit elements now to be described.

Connected also to the output side of the flip-flop F1 is one input of an AND gate G1, a second input to G1 passing through a further invertor 13 from the input side of the flip-flop F1. Thus the low signal from switch 40, present at the input of flip-flop F1, is inverted to provide a high signal at the second input to the gate G1, which, with the high signal from the output of flip-flop F1 at the first input to gate G1, gives a resulting high output signal from the gate G1. This is fed to a further flip-flop F2 which is similarly triggered by switch S1; and the resulting output from F2 passes via a capacitor C3 and resistor R3 to a transistor switch S3, which brings in a relay L2 to re-start the main motor by holding on a switch S5 in parallel with a manual start button S6.

In order to ensure that it is not possible for the motor to re-start other than if a fault signal is immediately followed by a good signal during slowing down of the machine, there is also incorporated a timed delay circuit. An AND gate G2 receives inputs from the trigger circuit of switch S1 and from the fault circuit of switch 40, i.e. from the input of flip-flop F1. If the gate G2 receives the first (high) fault signal from the switch 40 and a pulse signal from switch S1, the resultant high signal output is fed through a booster amplifier A3 and across a diode D1, which is in parallel with a high value resistor R4, to charge up a capacitor C4. A succeeding good (low) signal from switch 40 will cause the output of gate G2 to go "low", and allow the capacitor C4 to discharge through the resistor R4 (after a discharge period of about 1 second) down to a sufficient potential so that the resultant low signal is fed across an amplifier A4, in series with an invertor I4 and resistor R5, to switch on a transistor switch S4. The switch S4 is connected to the re-start switch S3, so that when switched on it prevents switch S3 from closing and bringing in the re-start relay L2. However during the discharge period of the capacitor C4 the switch S3 remains open, so that the second good signal from switch 40 would enable the motor to be re-started.

We claim:

1. A method for controlling the operation of a machine for feeding rod-like articles, such as cigarettes, in which said articles are fed intermittently along a channel in juxtaposed relationship and in which said machine continues operation and said articles continue to be fed intermittently for a period of time during decleration of said machine after stoppage of said machine is initiated, comprising the steps of:

(a) detecting any absence of said articles in said channel each time said articles are at rest in said channel between intermittent feeding thereof, (b) emitting a fault signal upon each detection of the absence of at least one article in said channel, (c) initiating the stoppage of said machine upon receipt of a fault signal whereby said machine is caused to decelerate, and (d) automatically restarting said machine if in a subsequent detecting step during said deceleration of said machine no further fault signal is emitted and received for a predetermined period of time during deceleration of said machine.

2. A device for controlling the operation of a machine for feeding rod-like articles, such as cigarettes, comprising means defining at least one flow channel along which the articles are fed intermittently in juxtaposed relationship, detection means for detecting the articles in said channel when at rest between intermittent feeding and for emitting a fault signal upon detection of the absence of an article in said channel, and control means operative to initiate stoppage of the machine upon receipt of a fault signal and to re-start the machine if no further fault signal is received for a predetermined period of time, said control means including a triggering circuit pulsed in timed relationship with said intermittent feeding steps and effective to stop said machine in the event that at least two consecutive fault signals are received from said detection means.

3. A device as claimed in claim 2 in which said control means further comprises a delay circuit to ensure that a good signal following a first fault signal will only be effective if received within a predetermined time delay.

4. A device as claimed in claim 2 in which said control means includes at least one counter or flip-flop element.

5. In a machine for packing rod-like articles, such as cigarettes, the improvement comprising means defining at least one flow channel having a lower end towards which said articles are fed, means for intermittently removing articles from said lower end, detection means for detecting articles in said channel and for emitting a fault signal on detection of the absence of at least one article therein, and control means connected to said detection means and operative to initiate a slowing down of said machine from its normal operating speed upon receipt of a fault signal and to bring said machine back to its normal operating speed if no further fault signal is received for a predetermined period of time.

6. A device for controlling the operation of a machine for feeding rod-like articles, such as cigarettes, in which said machine continues to feed said articles for a period of time during decleration of said machine after stoppage of said machine is initiated, comprising:

(a) means defining at least one flow channel along which said articles are fed intermittently in juxtaposed relationship, detection means for detecting any absence of said articles in said channel during a rest period between intermittent feeding and for emitting a fault signal upon detection of the absence of an article in said channel, (d) switch means connected to said machine for starting and stopping said machine, and (e) control means connected to said detection means and to said switch means and operative to open said switch means to initiate stoppage of said machine upon receipt of a fault signal emitted by said detection means during a first rest period whereby said machine is caused to decelerate and to automatically close said switch means to re-start said machine if during said deceleration of said machine no further fault signal is emitted by said detection means during a subsequent rest period and received by said control means for a predetermined period of time.

7. A device as claimed in claim 6 wherein said control means comprises means for emitting electrical pulses in timed relationship with the intermittent feeding steps of said machine and circuit means for receiving said pulses and said fault signals and effective to stop said machine in the event that any two consecutive fault signals are received from said detection means.

* * * * *